US009657587B2

(12) United States Patent
Bacic et al.

(10) Patent No.: US 9,657,587 B2
(45) Date of Patent: May 23, 2017

(54) ROTOR TIP CLEARANCE

(71) Applicant: ROLLS-ROYCE PLC, London (GB)

(72) Inventors: Marko Bacic, Oxford (GB); James Tooke, Derby (GB)

(73) Assignee: ROLLS-ROYCE plc, London (GB)

( * ) Notice: Subject to any disclaimer, the term of this patent is extended or adjusted under 35 U.S.C. 154(b) by 582 days.

(21) Appl. No.: 14/458,770

(22) Filed: Aug. 13, 2014

(65) Prior Publication Data

US 2015/0247417 A1 Sep. 3, 2015

(30) Foreign Application Priority Data

Aug. 29, 2013 (GB) ..... 1315365.5

(51) Int. Cl.

| | |
|---|---|
| ***F01D 19/02*** | (2006.01) |
| ***F01D 11/20*** | (2006.01) |
| ***F04D 27/00*** | (2006.01) |
| ***F04D 29/16*** | (2006.01) |
| ***F04D 29/52*** | (2006.01) |
| ***F01D 5/02*** | (2006.01) |

(Continued)

(52) U.S. Cl.

CPC ..... *F01D 19/02* (2013.01); *F01D 5/02* (2013.01); *F01D 7/02* (2013.01); *F01D 11/20* (2013.01); *F01D 21/003* (2013.01); *F01D 21/14* (2013.01); *F01D 25/12* (2013.01); *F04D 27/001* (2013.01); *F04D 29/164* (2013.01); *F04D 29/526* (2013.01); *F05D 2220/32* (2013.01); *F05D 2260/81* (2013.01); *F05D 2260/821* (2013.01); *F05D 2270/114* (2013.01); *F05D 2270/301* (2013.01); *F05D 2270/305* (2013.01); *F05D 2270/44* (2013.01); *F05D 2270/80* (2013.01)

(58) Field of Classification Search

CPC ..... F01D 11/20; F01D 11/24

See application file for complete search history.

(56) References Cited

U.S. PATENT DOCUMENTS 4,849,895 A * 7/1989 Kervistin ..... F01D 11/24 415/178

4,928,240 A 5/1990 Davison et al.

(Continued)

FOREIGN PATENT DOCUMENTS

EP 0 481 149 A1 4/1992

EP 0481150 A1 4/1992

(Continued)

OTHER PUBLICATIONS

Jan. 21, 2015 Search Report Issued in EP Application No. 14180787.

(Continued)

*Primary Examiner* — Woody Lee, Jr.

(74) *Attorney, Agent, or Firm* — Oliff PLC

(57) ABSTRACT

A method of controlling a rotor tip clearance arrangement of a gas turbine engine and a control system configured to control rotor tip clearance. Steps include measuring at least one engine parameter; determining engine power demand from the at least one engine parameter; and calculating rotor tip clearance given the determined engine power demand. The rotor tip clearance arrangement is controlled to increase or decrease the rotor tip clearance based on the difference between the calculated clearance and a predefined target clearance.

20 Claims, 5 Drawing Sheets

(51) Int. Cl.

| | |
|---|---|
| ***F01D 7/02*** | (2006.01) |
| ***F01D 21/00*** | (2006.01) |
| ***F01D 21/14*** | (2006.01) |
| ***F01D 25/12*** | (2006.01) |

(56) References Cited

U.S. PATENT DOCUMENTS

| | | | | | |
|---|---|---|---|---|---|
| 4,999,991 | A | * | 3/1991 | Haddad | F01D 11/24 415/178 |
| 5,076,050 | A | * | 12/1991 | Schwarz | F01D 11/24 415/117 |
| 5,281,085 | A | * | 1/1994 | Lenahan | F01D 11/24 415/116 |
| 5,839,268 | A | * | 11/1998 | Morris | F01D 25/164 384/99 |
| 6,487,491 | B1 | | 11/2002 | Karpman et al. | |
| 2001/0001845 | A1 | * | 5/2001 | Khalid | F01D 11/14 701/100 |
| 2007/0043497 | A1 | | 2/2007 | Leogrande et al. | |

FOREIGN PATENT DOCUMENTS

| | | | |
|---|---|---|---|
| EP | 2 372 105 | A2 | 10/2011 |
| EP | 2604806 | A2 | 6/2013 |
| GB | 2 233 397 | A | 1/1991 |

OTHER PUBLICATIONS

Search Report issued in British Patent Application No. 1315365.5 dated Mar. 17, 2014.

* cited by examiner

ROTOR TIP CLEARANCE

The present invention relates to a control system and a method of controlling rotor tip clearance in a gas turbine engine.

It is known to control the clearance between rotor blade tips and surrounding components of a gas turbine engine, for example in turbine or compressor stages, in order to improve engine efficiency and reduce the incidence of tip rub. One known control technique comprises air modulation, for example supplying cooling air to the casing to cause casing contraction. Another known control technique comprises mechanical actuation of the casing or segments mounted radially inwardly of the casing.

Such clearance control arrangements may be active, that is they are actively switched on or off or modulated dependent on a received signal, or passive, that is they respond automatically when predetermined conditions exist without an active control signal. An active air modulation arrangement is disclosed in EP2372105 in which a heating control chamber transfers hot air to the casing to heat it and therefore cause it to expand rapidly to increase clearance.

One disadvantage of all methods of controlling the rotor tip clearance is that they rely on current conditions or parameter measurements to inform future control movements. During the time lag between the measurement of current conditions and the control action being taken the clearance continues to change. Where the clearance is closing rapidly, for example during step climb or auto-throttle manoeuvres, the clearance may reduce to zero so that the rotor tips rub before the control action occurs or has an effect.

The present invention provides a control system and method of controlling rotor tip clearance that seeks to address the aforementioned problems.

Accordingly the present invention provides a method of controlling a rotor tip clearance arrangement of a gas turbine engine, the method comprising:

a) measuring at least one engine parameter;

b) determining engine power from the at least one engine parameter;

c) calculating rotor tip clearance given the determined engine power demand; and d) controlling the rotor tip clearance arrangement to increase or decrease the rotor tip clearance based on the difference between the calculated clearance and a predefined target clearance.

Advantageously the method of the present invention controls the rotor tip clearance arrangement earlier than in previous methods that rely on the engine response, and therefore reduces the incidence of rotor tip rub.

Step b) may be performed by an auto-throttle arrangement or a step climb alleviation arrangement. Advantageously the method of the present invention reduces tip rub in the rapid transient engine thrust changes caused by these control conditions.

The at least one engine parameter may comprise at least one of a shaft speed, an engine inlet pressure, a compressor pressure and a turbine pressure. For example it may comprise the shaft speed, compressor pressure or turbine pressure for any of the high pressure, intermediate pressure or low pressure shafts of the gas turbine engine. Advantageously, such parameters are typically measured already so no additional sensors are required to measure the at least one engine parameter.

Step b) may comprise determining the engine power demand from two or more of the measured engine parameters. For example, the engine power demand may be determined from the ratio of two engine pressures.

There may be a step between steps b) and c) to measure or calculate at least one parameter that affects clearance. The at least one parameter that affects clearance may be an engine temperature or a shaft speed, for example a compressor stage temperature, a compressor exit temperature, high pressure shaft speed, intermediate pressure shaft speed, low pressure shaft speed, a turbine entry temperature, or a turbine exit temperature.

Step d) may be performed within the time lag between the engine power demand signal and the engine response thereto. The time lag may be in the range of 100 to 2000 ms. The time lag may be in the range of 500 to 1000 ms. Advantageously, the method therefore controls tip clearance earlier than in known methods, by the length of the time lag, and so reduces the incidence of rotor tip rub. Advantageously the rotor blade and casing lives are extended and the efficiency of the engine remains higher for longer than in known methods.

Step c) may comprise calculating component growth of components affecting the clearance and determining the resultant clearance. The component growth may comprise mechanical growth and thermal growth relative to baseline component dimensions. The growth may be calculated from the measured or calculated parameter that affects clearance.

The steps of the method may be repeated.

The present invention provides a computer program having instructions adapted to carry out the method described; a computer readable medium, having a computer program recorded thereon, wherein the computer program is adapted to make the computer execute the method described; and a computer program comprising the computer readable medium as described.

The present invention also provides a control system configured to carry out the method as described.

The present invention also provides a control system configured to control rotor tip clearance in a gas turbine engine, the control system comprising:

a) a sensor to measure an engine parameter;

b) a processor to determine engine power demand from the engine parameter and to calculate rotor tip clearance from the engine power demand;

c) a comparator configured to compare the calculated rotor tip clearance with a predefined target clearance; and d) a rotor tip clearance arrangement configured to increase or decrease the rotor tip clearance based on the output of the comparator.

Advantageously the control system of the present invention controls rotor tip clearance earlier than previous control systems and thereby reduces the incidence of rotor tip rub.

The rotor tip clearance arrangement may be an active arrangement. The rotor tip clearance control arrangement may comprise at least one cooling air source to selectively supply cooling air to a casing surrounding the rotor tips. Additionally or alternatively the rotor tip clearance control arrangement may comprise at least one actuator to move a casing or at least one casing segment relative to the rotor tips. Advantageously the rotor tip clearance arrangement acts under the control of the control system to better control the clearance and to reduce tip rub.

The control system may comprise multiple sensors each measuring an engine parameter.

The present invention also provides a gas turbine engine comprising a control system as described.

Any combination of the optional features is encompassed within the scope of the invention except where mutually exclusive.

The present invention will be more fully described by way of example with reference to the accompanying drawings, in which.

Figure 1:
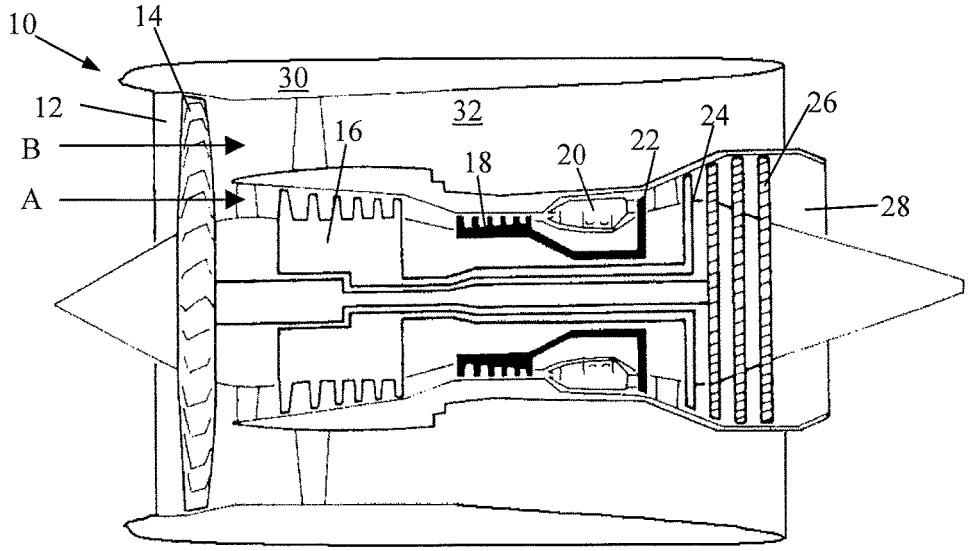
FIG. 1 is a sectional side view of a gas turbine engine.

A gas turbine engine 10 is shown in FIG. 1 and comprises an air intake 12 and a propulsive fan 14 that generates two airflows A and B. The gas turbine engine 10 comprises, in axial flow A, an intermediate pressure compressor 16, a high pressure compressor 18, a combustor 20, a high pressure turbine 22, an intermediate pressure turbine 24, a low pressure turbine 26 and an exhaust nozzle 28. A nacelle 30 surrounds the gas turbine engine 10 and defines, in axial flow B, a bypass duct 32.

Figure 2:
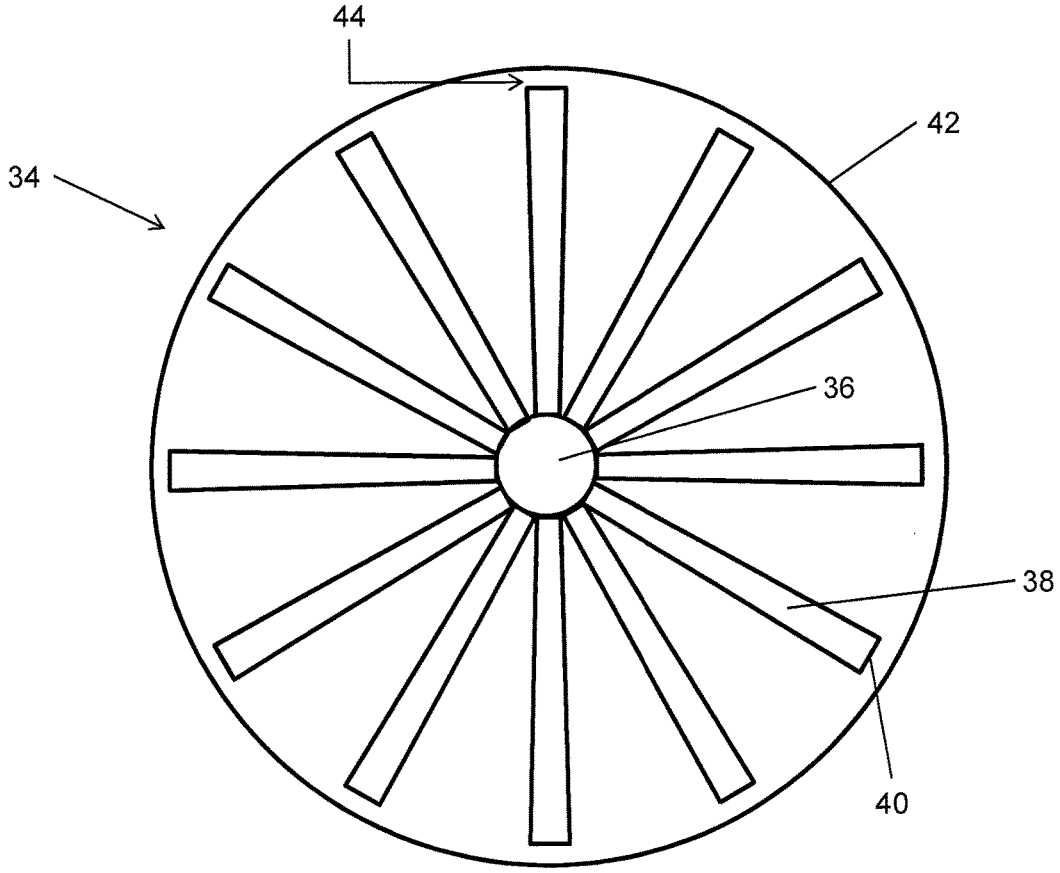
FIG. 2 is a schematic illustration of a rotor stage of a gas turbine engine.

Each of the fan 14, intermediate pressure compressor 16, high pressure compressor 18, high pressure turbine 22, intermediate pressure turbine 24 and low pressure turbine 26 comprises one or more rotor stages. A schematic illustration of a rotor stage 34 is shown in FIG. 2 comprising a rotor hub 36 from which radiate a plurality of blades 38. The blades 38 each comprise a blade tip 40 at the radially distal end from the hub 36. Radially outside the blade tips 40 is a rotor stage casing 42 which may include a segment assembly 56 comprising a plurality of segments forming its radially inner surface as will be understood by those skilled in the art. Between the blade tips 40 and the rotor stage casing 42 is a clearance 44.

In use of the gas turbine engine 10, working fluid (air) does work on the rotor blades 38 as it passes substantially axially through the engine 10. Working fluid that passes over the blade tips 40 through the clearance 44 does no useful work and therefore reduces the efficiency of the engine 10 and increases fuel consumption. However, the clearance 44 is necessary to prevent the blade tips 40 rubbing against the rotor stage casing 42 which causes damage to one or both components. Tip rub is a transient effect because the rub erodes the blade tip 40 or casing surface which results in the clearance 44 being increased and therefore the engine efficiency reducing.

Additionally the clearance 44 is not constant throughout use of the gas turbine engine 10. Taking the example of a gas turbine engine 10 used to power an aircraft, the rotor stage 34 components grow and shrink in response to centrifugal forces and temperature changes resulting from different engine operating conditions. Thus when the engine 10 is cold, before use, the rotor blades 38 have a defined radial length and the rotor stage casing 42 has a defined diameter and is annular. The components each grow or shrink by different amounts and with a different time constant governing the speed at which the growth or shrinkage occurs. The growth due to centrifugal forces is substantially instantaneous.

Figure 3:
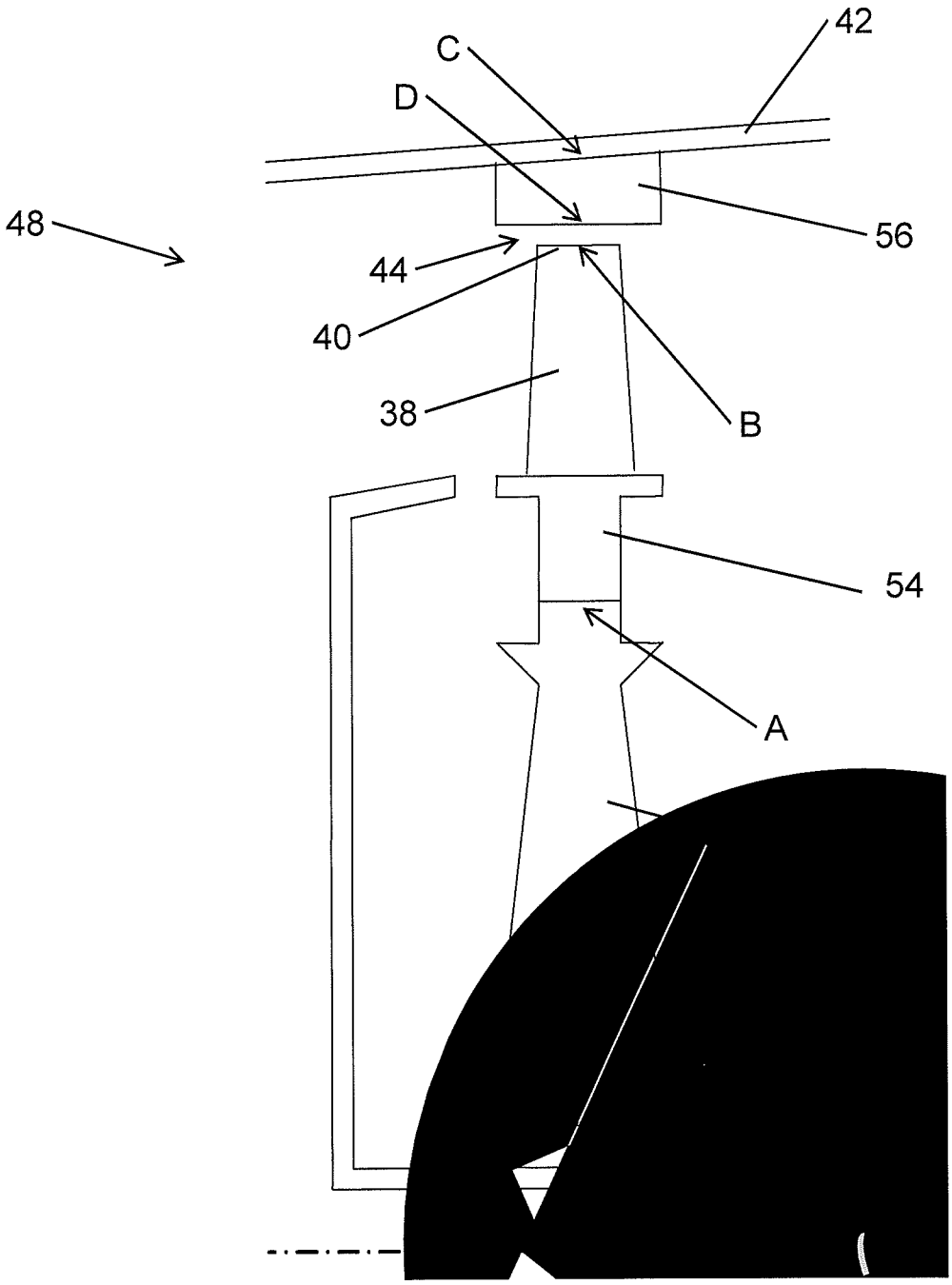
FIG. 3 is a schematic illustration of an enlargement of a part of a rotor stage of a gas turbine engine.

FIG. 3 is an enlargement 48 of part of the rotor stage. The hub 36 is formed as a disc 52 upon which the plurality of rotor blades 38 is mounted. Each rotor blade 38 includes an integral blade root 54 which comprises suitable features, such as a fir tree shape, to enable secure mounting to the disc 52. Except where distinction is required the term rotor blade 38 in this description should be understood to include the blade root 54. The rotor stage casing 42 optionally has a segment assembly 56 on its radially inner surface. The segment assembly 56 is comprised of a plurality of discontinuous segments in a circumferential array. The segments may be actively or passively controlled to move radially inwardly or outwardly to change the clearance 44 between them and the blade tips 40. The segments may be controlled by a combination of active and passive means; for example, passive segment actuation combined with active cooling air modulation or vice versa.

The segment assembly 56 grows radially inwardly whereas the rotor stage casing 42 and disc 52 grow radially outwardly and the rotor blades 38 elongate radially. Thus the clearance 44 reduces during engine acceleration phases of the flight such as ramp up and the start of take-off. Similarly, the clearance 44 increases during engine deceleration phases. There is a settling period after an engine acceleration or deceleration during which the clearance 44 may fluctuate before settling to a steady-state clearance 44.

It is known to apply active or passive tip clearance control arrangements to reduce the variation of clearance 44. For example cool air can be selectively delivered to passages in the rotor stage casing 42 to cool the rotor stage casing 42 and thereby reduce the diameter or retard the growth of the diameter. Alternatively the segment assembly 56 radially inside the rotor stage casing 42 can be moved mechanically to change the clearance 44.

Figure 4:
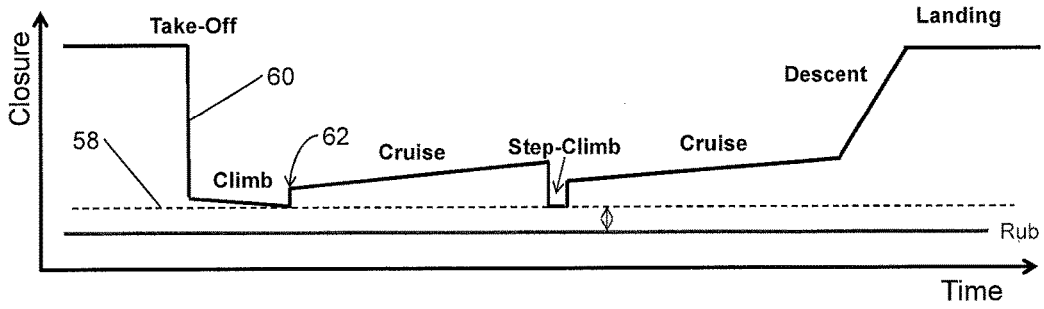
FIG. 4 is a schematic graph of rotor tip clearance against flight phases.
Figure 5:
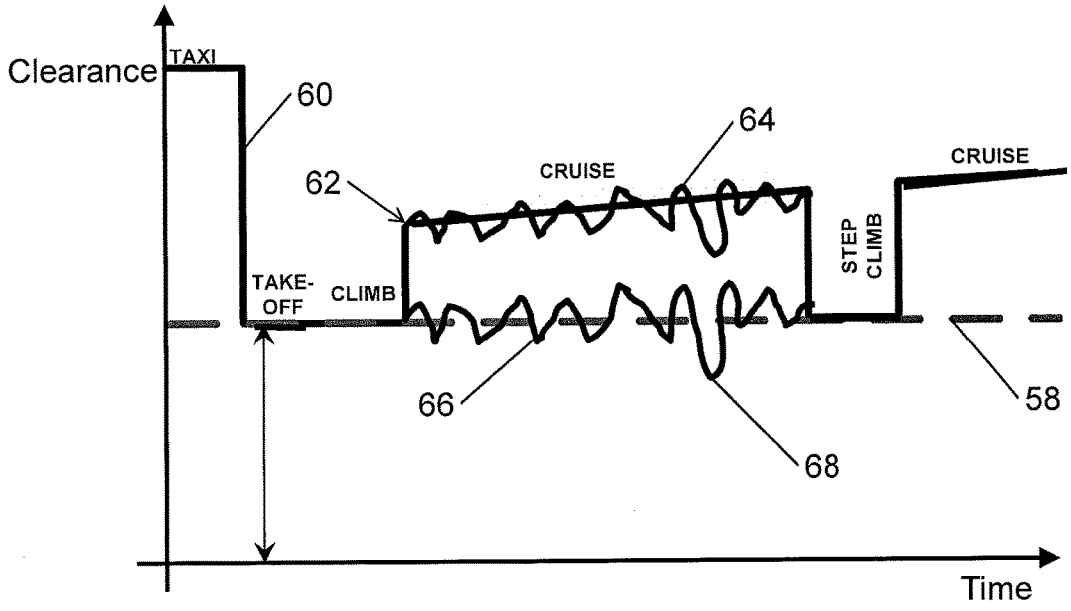
FIG. 5 is a schematic graph of rotor tip clearance against flight phases.

FIG. 4 is a schematic graph of rotor tip clearance for a rotor in a gas turbine engine 10 used to power an aircraft. FIG. 5 is an enlargement of part of the schematic graph of FIG. 4. The graphs are not to scale. Tip rub occurs when the clearance of at least one rotor blade 38 is 0 mm. Line 58 represents the predefined minimum clearance. This is greater than 0 mm to allow for measurement uncertainty, different blade lengths, rotor asymmetry and rapid transient effects such as gust loading. Typically the minimum clearance 58 is a few millimeters but the precise size is dependent on the engine 10, the particular rotor stage 34, the accuracy of the tip clearance measurement or estimation, and other factors as will be apparent to the skilled reader.

Line 60 is a typical target clearance without any clearance control. In the taxi phase of a flight the engine 10 is cold and is running at ground idle shaft speeds. Thus the expected clearance is large. In the take-off and climb phases of the flight the engine 10 is run at substantially maximum power demand so the expected clearance reduces significantly. Typically the rotor stages 34 are designed so that the target clearance 60 in these phases is equal to the minimum clearance 58.

In a first cruise phase of the flight the engine power demand is reduced, resulting in the rapid increase in target clearance 60 seen at 62. The target clearance 60 increases marginally through an extended cruise phase as thrust is reduced in response to the gradually reducing aircraft weight as fuel is burnt. Superimposed on line 60 in FIG. 5 is an exemplary actual clearance 64 in the cruise phase due to auto-throttle control. Auto-throttle is an aircraft control mechanism in which the pilot sets a desired aircraft speed, for example 0.85 Mach, and the aircraft controller adjusts the demanded thrust in order to deliver that aircraft speed. The engine controller receives the demanded thrust and controls the engine in order to deliver that thrust. This results in frequent very rapid changes in the thrust demand and consequent rapid variations of actual clearance 64. The target clearance 60 in the cruise phase must therefore be large enough that none of the transient decreases in actual clearance 64 will result in a clearance less than the minimum clearance 58 since there is then a risk of tip rub of one or more of the rotor blades 38.

In a step climb flight phase the engine power demand is again increased rapidly and the clearance consequently eroded. Step climb is an example of slam acceleration to maximum climb thrust. The target clearance 60 is generally designed to equal the minimum clearance 58 during step climb. The target clearance 60 during the cruise phase must therefore be sufficient to allow slam acceleration to maximum climb thrust. A step climb phase is typically followed by another cruise phase in which the target clearance 60 and actual clearance 64 continue from their values before the step climb.

Figure 6:
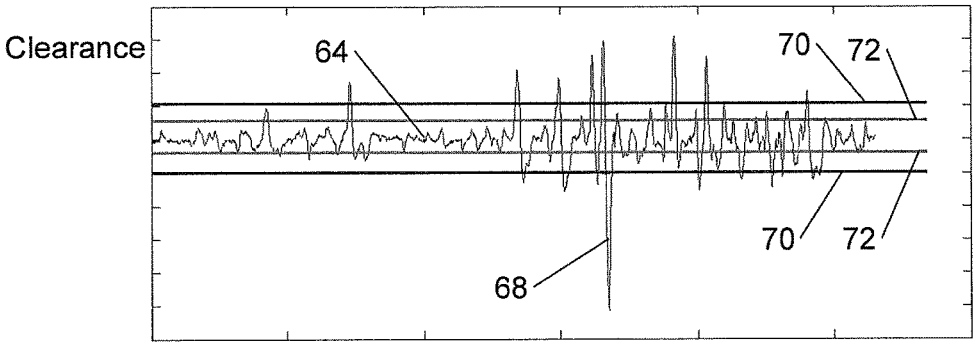
FIG. 6 is a graph illustrating control bands for rotor tip clearance control.

It is beneficial to minimise the area between the target clearance 60 and minimum clearance 58 since this improves the efficiency of the engine 10. A tip clearance control arrangement, for example as described in EP2372105, can be used to control to a target clearance 60 during cruise that equals, or at least approaches, the minimum clearance 58. FIG. 6 illustrates exemplary control bands 70, 72 that may be set around the target clearance 60. The wider control band 70 triggers the clearance control arrangement only where the variation of actual clearance 66 from target clearance 60 is large, therefore reducing the risk of tip rub. The narrower control band 72 triggers the clearance control arrangement where the variation of actual clearance 66 from target clearance 60 is modest, so the risk of tip rub is smaller than for the wider control band 70 but the clearance control arrangement is triggered more frequently, thereby increasing wear.

Where a large reduction in actual clearance 66 caused by auto-throttle controlling coincides with errors in tip clearance measurement or estimation and/or with gust loads or similar factors there is an increased risk of tip rub. In particular, a large reduction in clearance as indicated at 68, which significantly exceeds whichever control band 70, 72 is used, may not be controlled quickly enough after the clearance control arrangement is triggered to avoid tip rub.

The control system and method of the present invention enable a practical implementation of the target clearance 60 equalling, or at least being much closer to, the minimum clearance 58 during cruise phases of a flight and auto-throttle controlled flight phases without increasing the risk of tip rub or compromising the capacity for slam accelerations.

Figure 7:
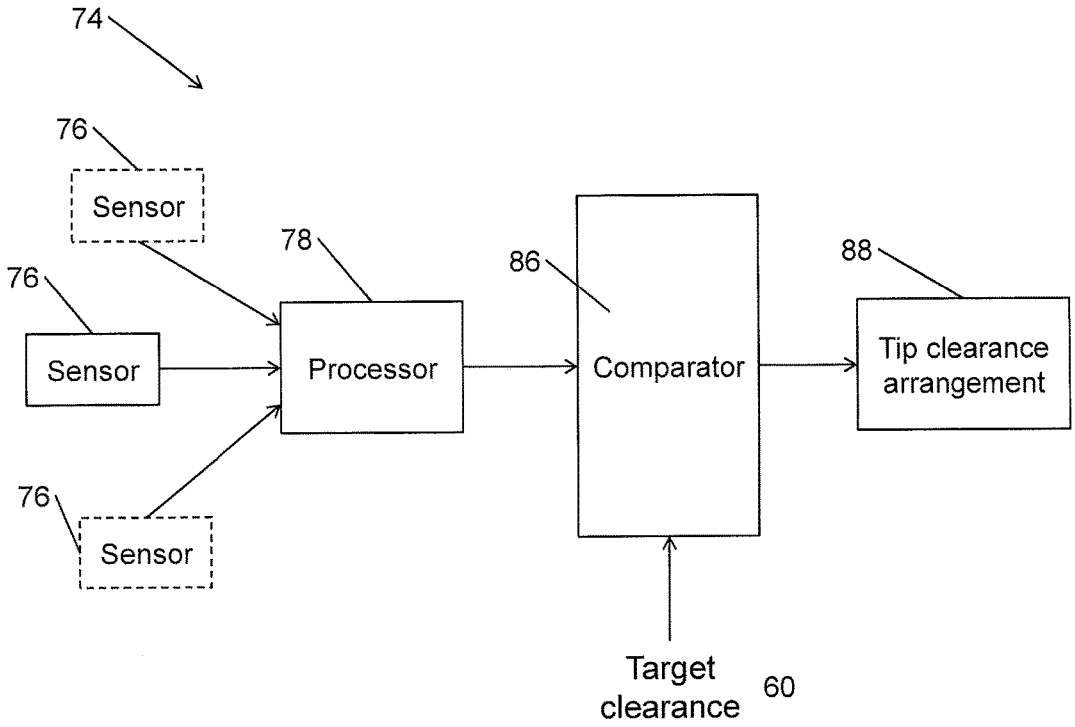
FIG. 7 is a schematic block diagram of the control system of the present invention.

FIG. 7 schematically shows the control system 74 according to the present invention. At least one sensor 76, optionally multiple sensors 76, is provided to measure an engine parameter of the gas turbine engine 10. The engine parameter is one from which the engine power demand may be determined. For example, the engine parameter may be a shaft speed such as the low pressure shaft speed N1 or NL. Alternatively the engine parameter may be an engine pressure. Where two or more sensors 76 are provided which each measure an engine pressure, a pressure ratio can be derived from two measured engine pressures from which the engine power demand can be determined. The sensor or sensors 76 measure the engine parameter or engine parameters repeatedly so that real-time rotor tip clearance control can be achieved. For example, a shaft speed may be measured every 6-100 ms, preferably every 25 ms.

The engine parameter measurements taken by the or each sensor 76 are passed to a processor 78. The processor 78 is arranged or configured to determine the engine power demand from the measured engine parameter or engine parameters. The processor 78 may be a function of the engine electronic controller, a function of another controller or may be a separate processor. The processor 78 may be acting as an auto-throttle controller when determining the engine power demand from the measured engine parameter or engine parameters. Advantageously the processor 78 repeatedly determines the engine power demand each time a new measurement is provided by the sensor 76 or one of the sensors 76. Thus the engine power demand is always calculated using the most recent measurements. Alternatively the processor 78 may be configured to determine the engine power demand at a fixed iteration rate, for example every 100-1000 ms.

Figure 8:
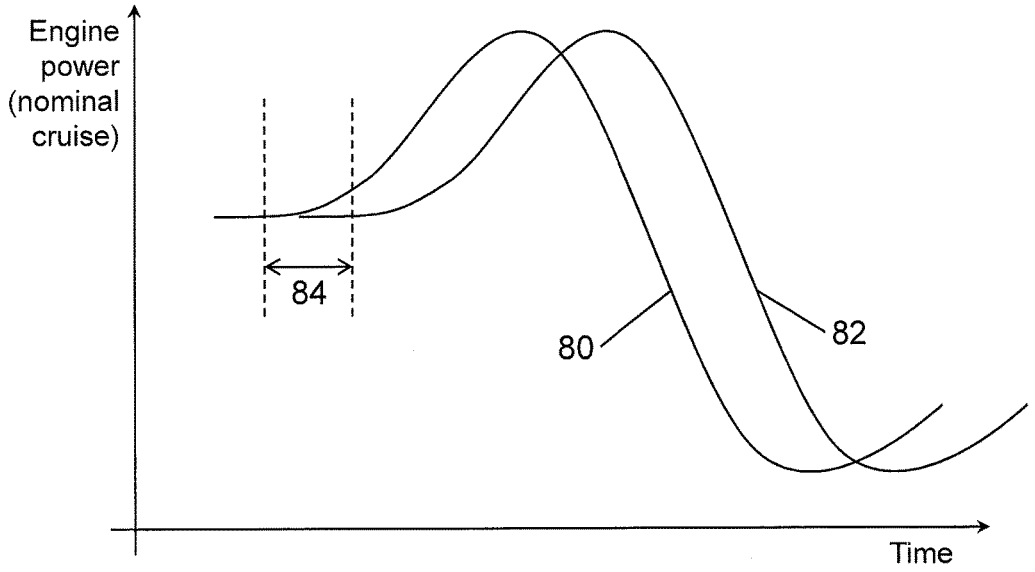
FIG. 8 is a graph of engine power against time.

FIG. 8 is a graph showing engine power against time. An exemplary engine power demand curve 80 is shown, which may be an oscillation due to auto-throttle. The engine power response curve 82 has substantially the same shape as the demand curve 80. However, the engine power response curve 82 lags behind the engine power demand curve 80 by a time period indicated by the double-headed arrow 84. The time lag 84 is dependent on the engine 10, the control iteration, engine power condition, environmental and other factors. In a typical aircraft gas turbine engine 10 the time lag 84 is in the range 100-2000 ms, preferably 500 ms to 1000 ms.

The processor 78 is also arranged or configured to calculate rotor tip clearance from the engine power demand 80. Unlike previous rotor tip clearance control systems which have calculated the rotor tip clearance from the engine power response 82, the control system 74 of the present invention calculates the rotor tip clearance on the basis of the engine power demand 80. Thus this is a prediction of the clearance when the engine response reaches the power demanded. Advantageously where the clearance calculated from the engine power demand 80 exceeds the target clearance 60, mitigation action can be triggered without the time lag 84 so that tip rub can be avoided.

The processor 78 passes the calculated rotor tip clearance to a comparator 86. The comparator also receives a predefined target clearance 60 for the same engine power demand 80. The target clearance 60 may, for example, be stored in memory or may be calculated from an ideal engine model. Preferably the comparator 86 applies the wider or narrower control bands 70, 72 to the target clearance 60. It then compares the calculated rotor tip clearance to the thresholds of the control band 70, 72. If the calculated clearance is within the control band 70, 72 no tip clearance control action is required. However, if the calculated clearance is outside the control band 70, 72 a signal is sent to a tip clearance arrangement 88. Optionally, a null, or no action required, signal may be sent to the tip clearance arrangement 88 where the calculated clearance is within the control band 70, 72 to eliminate the possibility of a fault in the comparator 86 being interpreted as a calculated clearance that falls within the control band 70, 72.

The tip clearance arrangement 88 comprises an active tip clearance control mechanism. Preferably it is a tip clearance control mechanism as described in EP2372105, which is capable of reacting to rapid changes in control signal as required during auto-throttle control of the engine 10. However, the tip clearance arrangement 88 may be any active tip clearance control mechanism. For example the tip clearance arrangement 88 may comprise one or more segment actuators to mechanically move the segment assembly 56 radially in towards the rotor tips 40 or radially out from the rotor tips 40.

Figure 9:
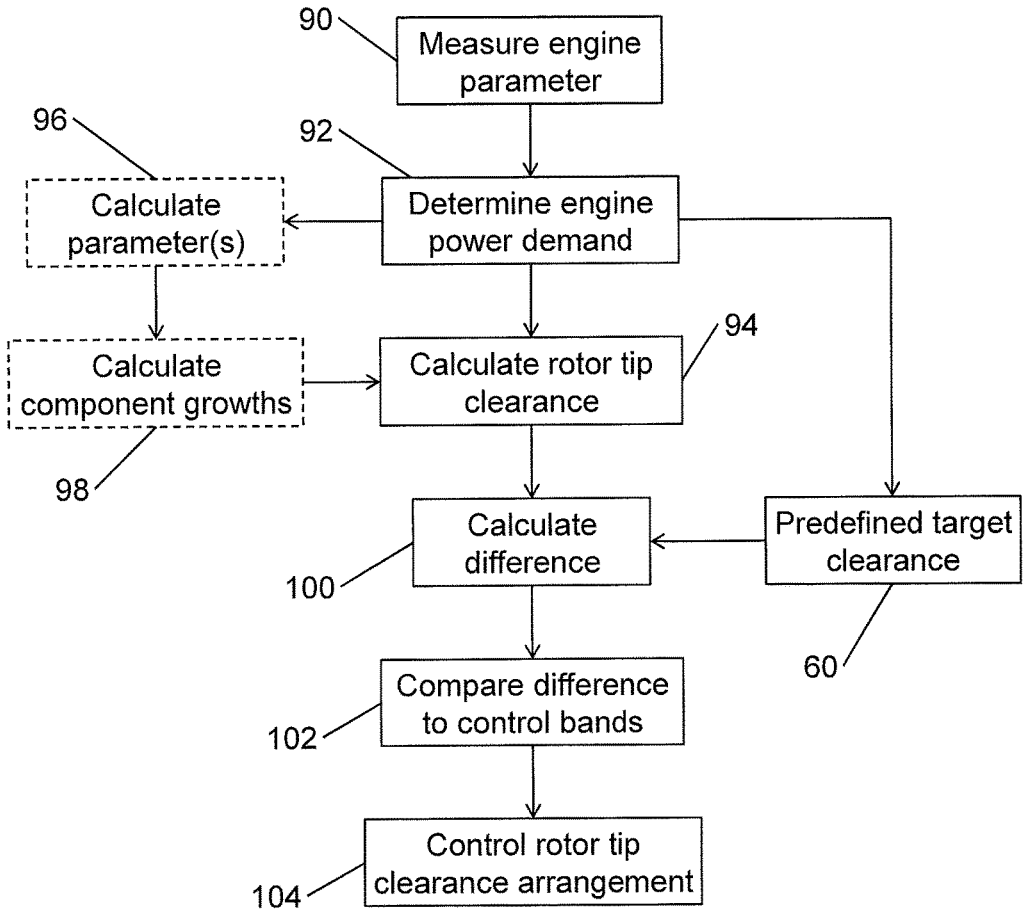
FIG. 9 is a flow chart of the method of the present invention.

The method of the present invention is described with respect to FIG. 9. In a first step 90 at least one engine parameter is measured by the sensor 76. As discussed above the engine parameter may be a shaft speed, a pressure in the engine 10 or any other engine parameter from which engine power demand 80 can be determined. The engine power demand 80 for that parameter value or those parameter values is determined in step 92.

In step 94 the rotor tip clearance is calculated from the engine power demand 80. Optionally there may be additional steps to calculate at least one parameter, step 96, and to calculate component growths, step 98. The step 96 of calculating at least one parameter may comprise calculating an engine temperature or shaft speed that affects the clearance 44 of the rotor tips 40 from the rotor stage casing 42 or segment assembly 56. The parameter or parameters are calculated from the engine power demand 80 determined at step 92 so that it or they are an estimate of the measurement that would be obtained when the engine power response 82 reaches the determined engine power demand 80. Such parameters may be an air temperature at a middle rotor in the high pressure compressor T30, a compressor exit temperature T41, a turbine entry or exit temperature, or a high pressure shaft speed N3 or NH. Any one or more of these parameters can be used at step 98 to calculate the growth of the various components affecting clearance 44. Thus the growth of the rotor blades 38, blade root 54, disc 52, rotor stage casing 42 and (where applicable) segment assembly 56 can each be calculated relative to baseline dimensions. For example, the baseline may be the component dimensions, size or radial position at the previous measurement interval or at engine start up or another defined point in the engine cycle. The growth may be mechanical and thermal, each being calculated separately and combined to give the total growth. The calculated component growths can be passed to the processor 78 for use in the calculation of the rotor tip clearance at step 94.

In step 100 the difference between the rotor tip clearance calculated at step 94 and the target clearance 60 is calculated. The predefined target clearance 60 may be looked up from a table or graph stored in memory or otherwise available. Alternatively it may be calculated from a predefined algorithm. In each case it is the target clearance 60 for the engine power demand 80 determined at step 92.

The calculated difference is then compared to the control bands 70, 72 defined around the target clearance 60 at step 102. The result is supplied to control a rotor tip clearance arrangement 88 at step 104. The control may be in the form of opening or closing a valve to supply or cut off cooling air to portions of the rotor stage casing 42 or segment assembly 56. Alternatively the control may be in the form of activating mechanical actuators to move the rotor stage casing 42 or segment assembly 56 radially inwards or outwards. Alternatively the control may activate both types of rotor tip clearance arrangement 88 or any other type of active tip clearance arrangement.

The step 104 to control the rotor tip clearance arrangement 88 may comprise increasing or decreasing the clearance 44. Thus where the rotor tip clearance calculated at step 94 is larger than the predefined target clearance 60 and the difference calculated at step 100 is larger than the control band 70, 72 the control step 104 acts to reduce the clearance 44 to improve efficiency. Conversely, where the rotor tip clearance calculated at step 94 is smaller than the predefined target clearance 60 and the difference calculated at step 100 is larger than the control band 70, 72 the control step 104 acts to increase the clearance 44 to reduce the risk of tip rub.

Advantageously the method of the present invention is based on the engine power demand 80 rather than the engine power response 82 and so the control at step 104 occurs earlier, by the amount of the time lag 84, than in known methods. Where the rotor tip clearance arrangement 88 is quick acting, the additional 100-2000 ms saved by the present invention is sufficient to significantly reduce the incidence of tip rubs without implementing a narrower control band 72 and thereby activating the rotor tip clearance arrangement 88 more frequently.

The step 100 to calculate the difference and/or the step 102 to compare the difference to the control bands 70, 72 may also output to a control system for the engine 10. Specifically a maximum rate of acceleration may be calculated based on the available tip clearance 44 and information about how quickly the rotor tip clearance arrangement 88 can act to maintain adequate clearance 44. Thus a rate limiter can be applied, based on the method of the present invention, to control the rate of acceleration of the engine 10 to prevent or at least minimise tip rub.

The control system and method of the present invention are preferably encompassed in computer-implemented code and stored on a computer-readable medium. It is thus a computer-implemented control system and a computer-implemented method of controlling rotor tip clearance. The method may be implemented on a basic computer system comprising a processing unit, memory, user interface means such as a keyboard and/or mouse, and display means. The method is preferably performed in 'real-time', that is at the same time that the data is measured. In this case the computer may be coupled to the control system. Where the control system forms part of a gas turbine engine 10 the computer may be an electronic engine controller or another on-board processor. Where the gas turbine engine 10 powers an aircraft, the computer may be an engine controller, a processor on-board the engine 10 or a processor on-board the aircraft.

Although a three-shaft gas turbine engine 10 has been described the control system and method of the present invention are equally applicable to a two-shaft gas turbine engine 10. The invention is felicitous in use for the rotor stages 34 of gas turbine engines 10 used for other purposes than to power an aircraft. For example the control system and method can be used for an industrial gas turbine engine or a marine gas turbine engine.

The invention claimed is:

1. A method of controlling a rotor tip clearance arrangement of a gas turbine engine, the method comprising:

a) measuring at least one engine parameter;

b) determining engine power demand from the at least one engine parameter, the determined engine power demand being an estimated value of future engine power predicted prior to an engine power response;

c) calculating a predicted rotor tip clearance corresponding to the determined engine power demand; and d) controlling, prior to the engine power response, the rotor tip clearance arrangement to increase or decrease the rotor tip clearance based on a difference between the calculated rotor tip clearance and a predefined target clearance.

2. The method as claimed in claim 1, wherein step b) is performed by an auto-throttle arrangement or a step climb alleviation arrangement.

3. The method as claimed in claim 1, wherein the at least one measured engine parameter includes at least one of: a shaft speed, an engine inlet pressure, a compressor pressure, and a turbine pressure.

4. The method as claimed in claim 1, wherein step b) includes determining the engine power demand from two or more of the measured engine parameters.

5. The method as claimed in claim 1, further comprising a step between steps b) and c) to calculate at least one parameter that affects rotor tip clearance based on the determined engine power demand.

6. The method as claimed in claim 5, wherein the at least one parameter includes an engine temperature, a shaft speed, a compressor stage temperature, a compressor exit temperature, high pressure shaft speed, intermediate pressure shaft speed, low pressure shaft speed, a turbine entry temperature, or a turbine exit temperature.

7. The method as claimed in claim 1, wherein step d) is performed within a time lag between determining the engine power demand and the engine power response.

8. The method as claimed in claim 7, wherein the time lag is in a range of 500 to 1000 ms.

9. The method as claimed in claim 1, wherein step c) includes: (i) calculating component growth of components affecting the rotor tip clearance, and (ii) determining a resultant clearance.

10. The method as claimed in claim 9, wherein the component growth includes mechanical growth and thermal growth relative to baseline component dimensions.

11. The method as claimed in claim 1, wherein the steps are repeated.

12. A computer program having instructions adapted to perform the method according to claim 1.

13. A non-transitory computer readable medium including a computer program recorded thereon, the computer program being configured to cause a computer to execute the method according to claim 1.

14. A control system configured to perform the method according to claim 1.

15. A gas turbine engine comprising the control system as claimed in claim 14.

16. A control system configured to control rotor tip clearance in a gas turbine engine, the control system comprising:

a sensor to measure an engine parameter;

a processor programmed to:

determine engine power demand from the engine parameter, the determined engine power demand being an estimated value of future engine power predicted prior to an engine power response;

calculate a predicted rotor tip clearance corresponding to the determined engine power demand;

compare the calculated predicted rotor tip clearance with a predefined target clearance; and output a control signal indicating a difference between the calculated predicted rotor tip clearance and the predefined target clearance; and a rotor tip clearance arrangement configured to increase or decrease the rotor tip clearance based on the outputted control signal, prior to the engine power response.

17. The control system as claimed in claim 16, wherein the rotor tip clearance arrangement is an active arrangement.

18. The control system as claimed in claim 16, wherein the rotor tip clearance arrangement includes at least one cooling air source to selectively supply cooling air to a casing surrounding a plurality of rotor tips.

19. The control system as claimed in claim 16, wherein the rotor tip clearance arrangement includes at least one actuator to move a casing or at least one casing segment relative to a plurality of rotor tips.

20. The control system as claimed in claim 16, further comprising multiple sensors each measuring a different engine parameter.

* * * * *